US005244094A

United States Patent [19]

Graff, Jr. et al.

[11] Patent Number: 5,244,094

[45] Date of Patent: Sep. 14, 1993

[54] MOLDED PULP TRAY FOR HOLDING COLD CONTAINERS

[75] Inventors: John F. Graff, Jr., Naperville; Gary P. Fedunok, Carol Stream, both of Ill.; Ray B. Swart, Chesterton, Ind.; Henry R. Vigue, Waterville, Me.

[73] Assignee: Keyes Fibre, Westerville, Mass.

[21] Appl. No.: 826,064

[22] Filed: Jan. 27, 1992

[51] Int. Cl.[5] ..... B65D 81/06

[52] U.S. Cl. ..... 206/564; 206/592; 206/593; 206/821; 229/2.5 R

[58] Field of Search ..... 206/521, 523, 557, 558, 206/560, 561, 564, 565, 821, 592, 593; 229/2.5 R

[56] References Cited

U.S. PATENT DOCUMENTS

| | | | |
|---|---|---|---|
| 2,210,102 | 8/1940 | Steudel | 229/2.5 R |
| 3,318,283 | 5/1967 | Maclam et al. | 206/557 |
| 3,502,241 | 3/1970 | Smith | 229/2.5 R |
| 3,526,077 | 9/1970 | Mixon | 229/2.5 R |

FOREIGN PATENT DOCUMENTS

| | | | |
|---|---|---|---|
| 6801813 | 8/1969 | Netherlands | 206/821 |
| 0740509 | 11/1955 | United Kingdom | 229/2.5 R |
| 0785914 | 11/1957 | United Kingdom | 229/2.5 R |
| 0813415 | 4/1959 | United Kingdom | 229/2.5 R |
| 1017645 | 1/1966 | United Kingdom | 224/2.5 R |

*Primary Examiner*—Jimmy G. Foster
*Attorney, Agent, or Firm*—Connolly & Hutz

[57] ABSTRACT

A molded pulp tray for holding cold containers includes a bottom wall with upwardly and outwardly extending side walls terminating in a peripheral edge. A plurality of upwardly extending, partitions divides the tray into a corresponding plurality of container receiving pockets. Each of the pockets is defined by a portion of the bottom wall and by four peripheral sides which includes at least one of the partitions and at least two of the side walls. Each pocket has at least one raised pillow extending upwardly from the bottom wall to support the lid of an inverted container located in the pocket with the pillow spaced inwardly of the peripheral sides to create a continuous peripheral groove between the pillow and the peripheral sides so that the edge of the outer surface of the lid may be located in the peripheral groove.

13 Claims, 3 Drawing Sheets

MOLDED PULP TRAY FOR HOLDING COLD CONTAINERS

BACKGROUND OF INVENTION

The present invention is directed to a tray for holding cold containers. Such cold containers may, for example, be ice cream containers having a removable lid. The containers must be stored under very cold conditions, such as at temperatures of about −20° F. to −30° F. during handling at production dairy and in shipment. Previous attempts at providing a shipping tray have been generally unsuccessful where the shipping tray is made, for example, from materials such as corrugate fiber board or chip board. The difficulties have particularly occurred with respect to the cold plastic lids shattering. The high percentage of shattered lids has resulted in plastic fragments being found in supermarket display cases which have rendered the product unsalable at retail. The shattering problem is particularly acute with containers having lids formed with label wells since such construction includes not only a peripheral flange or side wall, but also a lip extending outwardly of the label wells. Such plastic material is particularly fragile and susceptible to shattering.

It would be desirable if a storage and shipping tray could be provided for cold containers, particularly containers having plastic lids with label wells and extended side flanges. Such tray should ideally protect the containers from shock induced damage at the extremely cold temperatures maintained during handling at production facilities such as dairies and in shipment.

SUMMARY OF INVENTION

An object of this invention is to provide a tray for cold containers which meets the above needs.

A further object of this invention is to provide such a tray which may be effectively used with any container maintained in a cold environment and not simply ice cream containers.

In accordance with this invention the tray is made from a molded pulp material so as to take advantage of the strength and cushioning characteristics of that material. The tray is in the form of a bottom wall having upwardly and outwardly extending side walls which terminate in a peripheral upper edge. A plurality of upwardly extending partitions divide the tray into a corresponding plurality of container receiving pockets. Each of the pockets is defined by a portion of the bottom wall and by four peripheral sides, including at least one of the partitions and at least two of the side walls. Each pocket includes at least one raised pillow extending upwardly from the bottom wall spaced from the four peripheral sides to define a peripheral groove between the pillow and the peripheral sides. The pillow would fit in the lid well to provide the necessary support while the extended side flanges of the lid would be located in the groove isolated in air where there would be minimal shock.

In a preferred practice of this invention there are a number of pillows for being disposed in the lid well. Preferably the pillows comprise a single continuous ring-like pillow dimensioned and located to fit near the edge of the label well with a plurality, such as six, individual pillows within the continuous pillow.

Where the invention is used with, for example, ice cream containers, the tray would preferably contain three pockets for receiving three half-gallon size containers all of which would be maintained mounted on the tray by a plastic shrink film overwrap.

THE DRAWINGS

Figure 1:
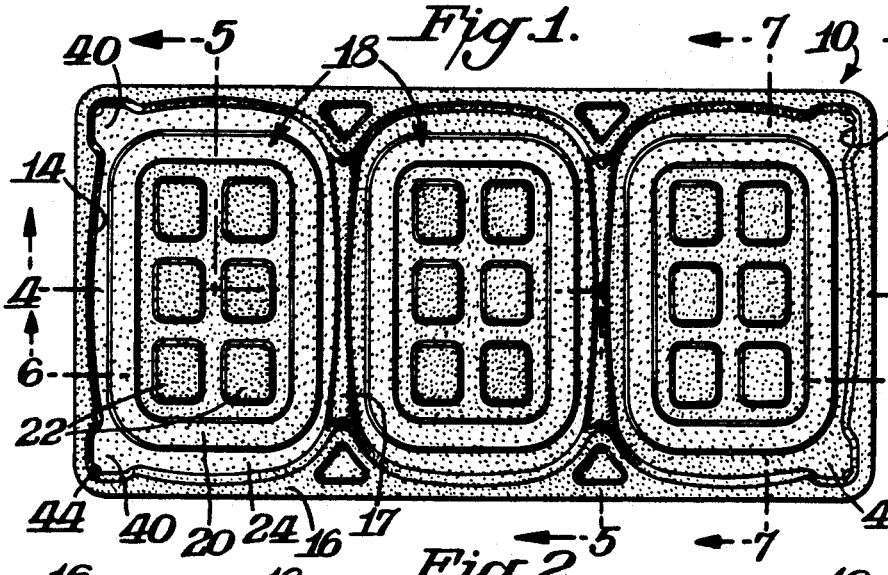
FIG. 1 is a top plan view of a molded pulp tray for holding cold containers in accordance with this invention.
Figure 3:
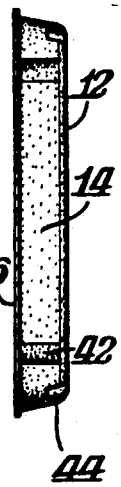
FIG. 3 is a side elevational view of the tray shown in FIGS. 1–2.
Figure 2:
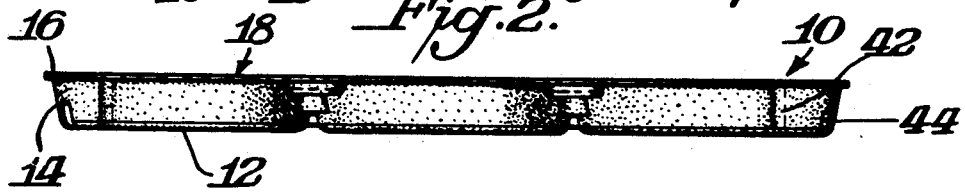
FIG. 2 is a front elevational view of the tray shown in FIG. 1.
Figure 4:
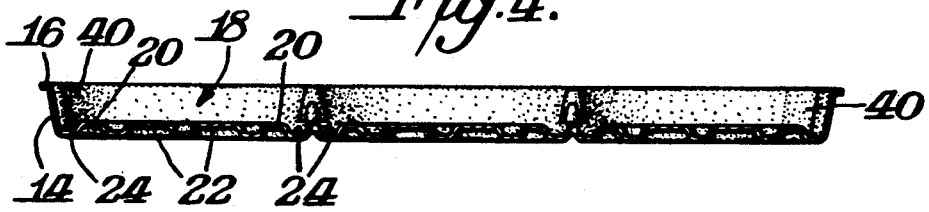
Figure 5:
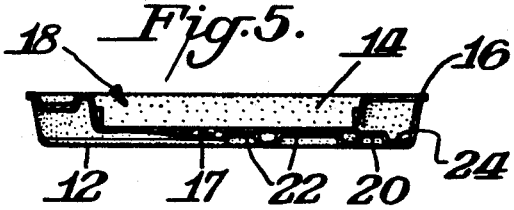
Figure 6:
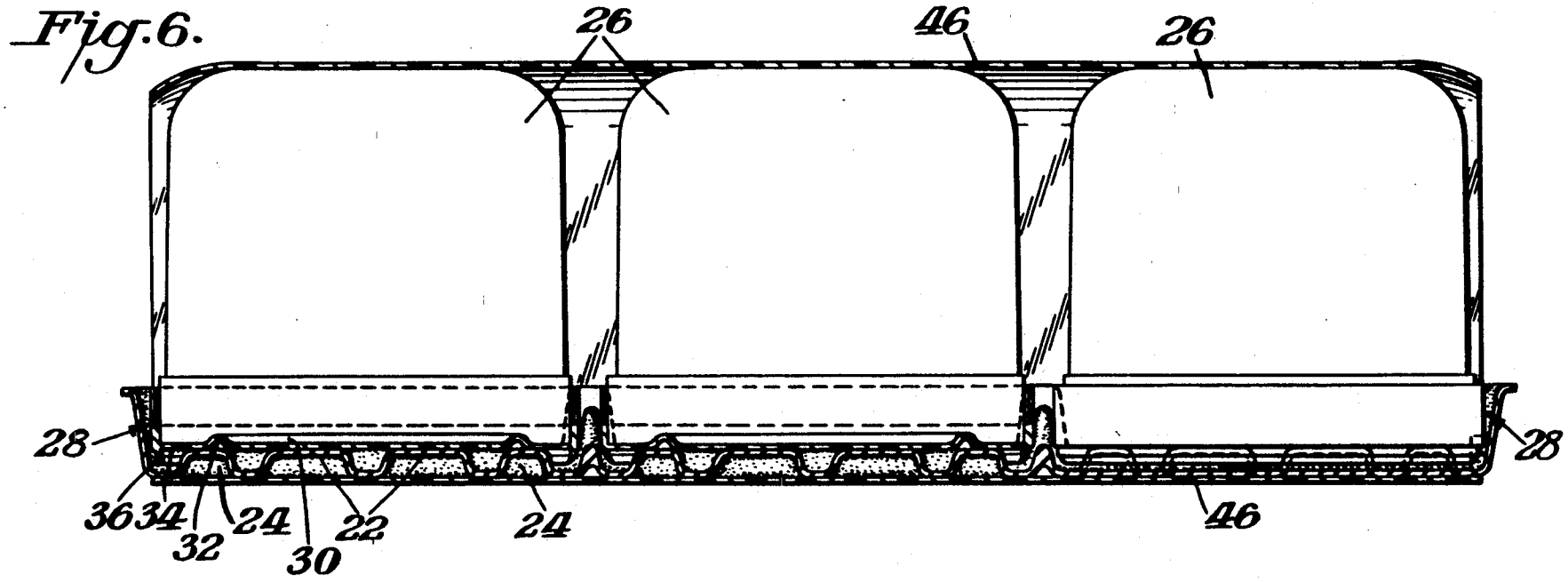
Figure 7:
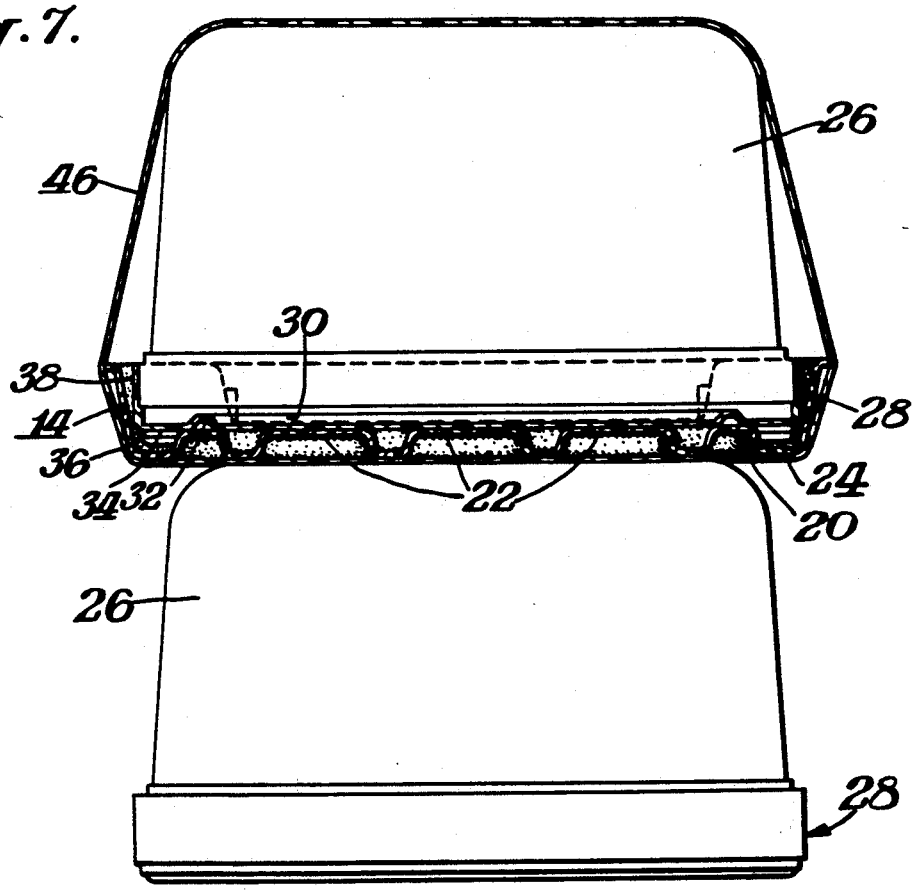
Figure 8:
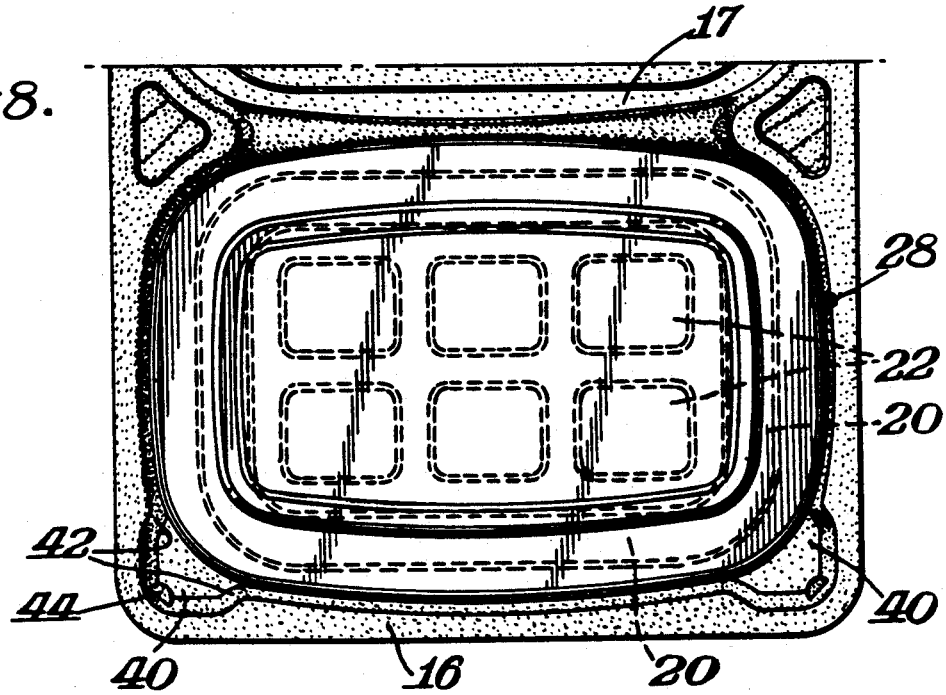

FIGS. 4–7 are cross-sectional views taken through FIG. 1 along the lines 4—4, 5—5, 6—6 and 7—7, respectively, with FIGS. 6 and 7 also showing containers mounted on the tray; and FIG. 8 is a plan view of the tray shown in FIGS. 1–7 showing the lid mounted in the tray of one pocket, but with the container being removed.

DETAILED DESCRIPTION

The present invention is directed to a tray 10 for holding cold containers such as, but not limited to, ice cream containers. The tray 10 is made from a molded pulp fiber material so as to take advantage of the unique features of molded pulp with regard to crushability to cushion and contain transmitted shock and the ability to be molded in complex stable shapes, as well as the strength of such material.

As illustrated in FIGS. 1–5, tray 10 includes a bottom wall 12 having upwardly and outwardly extending side walls 14 which terminate in a peripheral upper edge 16. The upward and outward incline of side walls 16 are advantageous not only from the standpoint of minimizing any contact with the side flanges of the container lid as later described, but also to permit the trays to be nested into each other for storage and shipping before use in holding containers.

As also illustrated, a plurality of upwardly extending partitions 17 are formed on bottom wall 12 to create a plurality of container receiving pockets 18. In the illustrated embodiment the tray is divided into three aligned pockets. It is to be understood that the invention may be practiced with any other geometric arrangement and number of pockets, such as a square or rectangular tray being divided into 2, 4, 6, etc. pockets and or an L-shaped tray, etc. Each of the pockets may be considered as being defined by a portion of bottom wall 12 and by at least one partition 17 and two side walls 14 with the partition (s) 17 and side walls 14 forming the four sides of each pocket 18.

A characteristic of the invention is the provision in each pocket 18 of at least one raised pillow extending upwardly from bottom wall 12. In the preferred practice of the invention the raised pillows include a ring-like pillow 20 of generally rectangular shape with rounded corners and include any number (preferably six) of raised pillows 22 disposed within peripheral pillow 20. A peripheral groove 24 results between the outer edge of pillow 22 and the sides which define the pocket 18.

The tray 10 is particularly designed to be used with containers having plastic lids which include label wells. For example, as best shown in FIG. 7 container 26 has a lid 28 with the container 26 being mounted in a respective pocket is in an inverted condition so that the lid rests on and is supported by the pillows 22, 24. Lid 28 includes a generally flat central surface 30 with a rectangular recess having a recess wall 32 and a further peripheral surface 32 coplanar with main central surface 30. An interned lip 36 extends beyond the flat surfaces 30, 34 with extended side flanges 38 stepped outwardly from the base of lip 36 and extending in a direction opposite to that of lip 36. This structure forms a label well with the surfaces 30,34 comprising the base of the label well and the lip 36 comprising the outward shoulder or wall of the label well. In use, a label identifying the product would be mounted in the label against the flat surfaces 30,34. A stiff paper liner containing product information would be inserted in the well and held in place by inclined lip 36. Side flanges 38 and lip 36 are of fragile construction due to their thin dimensions and stress from molding. Thus, the plastic lip and side flanges are easily damaged from shock at the cold temperatures such as −20° F. to −30° F. which prevail during handling at production and in shipment and storage.

Tray 10 has been found to provide dramatically effective results. When tested in drop tests a number of times, no damage resulted in the label well or shattering of the lid flanges or lip. The multiple pillows inside the label well provide good support for the containers while still allowing some give to absorb shock.

Tray 10 also includes extended square corners 40 at each of the four corners of tray 10. The corners 40 give additional clearance to minimize any contact of the lid flange 38 with the side walls 14 of tray 10. Additionally, the extended corners 40 result in a buttress strengthening formation 42,42 as well as reinforcing posts 44. A further feature of corners 40 is that there can be collapse upon impact to protect the round corners of the lid flange and lip which are already stressed in the plastic molding process. This is particularly important since the lid flange and lip quite brittle under the extremely low temperature conditions.

The floor of groove 24 should be planar to avoid any protrusions such as ribs which might contact flange 38 and provide shock points resulting in damage to the lid well.

By providing pillow 20 of a shape and location which generally conforms in dimension to the label well, there is a further advantage of the tray packer being able to locate the containers 26 accurately in each pocket 18 without having to carefully look at or struggle with the tray, thus making the packing job easier with the advantage of possibly being able to use less packers since such job is conventionally done manually.

After each container 26 is mounted in a respective pocket to fill the three pockets a conventional plastic shrink overwrap 46 is applied to maintain the containers properly mounted in place.

FIG. 6 illustrates the practice of this invention where tray 10 is used for packaging three half gallon containers 26. FIG. 7 shows how a number of trays could be stacked atop each other. For simplicity of illustration the bottom most tray is omitted and only the container 26 is shown in the lower portion of FIG. 7.

Tray 10 may be formed of any suitable dimensions with the dimensions being primarily dictated by the size and shape of container 26 and its lid 28. In the preferred practice of the invention tray 10 has an overall length of 16 ¼ inches and an overall width of 8 ¼ inches with an overall perpendicular height of one inch. Partitions 17 extend upwardly from bottom wall 12, preferably the same mount as the extension of pillows 20,22 such as, for example, 0.25 inches. Each pocket 18, preferably has a width of 5.1938 inches. Ring-like pillow 20 has an overall length of about 6.3 inches and an overall width of about 3.7 inches with the upper surface having a width of about 0.5 inches. Inner pillows 22 preferably have an overall length of about 1.3 inches and an overall width of about 1 inch.

Although partitions 17 are illustrated as being of the same height as the pillows, the partition 17 could be made higher up to the one inch perpendicular height of side walls 14. The side walls 14 and the peripheral edge 16 are particularly important in providing sufficient strengths to tray 10, thus, withstanding the forces encountered with the plastic overwrap 46 is applied.

As noted, the above dimensions are particularly designed to effectively support half-gallon ice cream containers of the type illustrated and described herein. It is to be understood, however, that other dimensions would be used for other size containers without departing from the practice of this invention. It is also to be understood that in the preferred practice of this invention the four side walls 14 are integrally joined together to form a continuous structure. The invention, however, in its broadest sense may be practiced with side wall segments having gaps or spaces therein. Similarly, ring-like pillow 20 is preferably formed of a continuous structure, but the invention may be practiced where the structure results from spaced segments. Other variations in the structure of tray 10 will be apparent to those skilled in the art given the teachings of this invention.

The construction of tray 10 is particularly advantageous since it results in the lip 36 extending just out of contact with the flat upper surface of bottom wall 12 while the lip 36 and side flanges 38 remain just out of contact with the sides of each pocket 18 since the lip 36 and side flanges 38 are disposed in the peripheral groove 24 located between ring-like peripheral pillow 20 and the sides of each pocket 18. Thus, the portions of lid 28 which are most fragile and most likely to shatter are suspended in air while the lid 28 itself and container 26 is effectively supported by tray 10. This isolation of the fragile portions of lid 28 avoids undesired contact of the fragile portions with the tray and provides clearance for some degree of collapse of the tray should a force as from dropping be applied.

What is claimed is:

1. A molded pulp tray for holding cold containers comprising a bottom wall, upwardly and outwardly extending side walls terminating in a peripheral edge, a plurality of partitions extending upwardly from said bottom wall to divide said tray into a corresponding plurality of container receiving pockets, each of said pockets being defined by a portion of said bottom wall and by four peripheral sides comprising at least one of said partitions and at least one of said side walls, each of said pockets having a raised pillow extending upwardly from said bottom wall comprising a lid support surface for supporting the lid of a container when a container is mounted in said pocket in an inverted condition with the lid facing downward, said pillow being spaced inwardly from said peripheral sides of said pocket to create a peripheral sides whereby the edge of the outer surface of the lid may be disposed in the groove said pillow comprising a ring-like outer pillow located near but spaced from said peripheral sides, said outer pillow comprising means for cushioning and supporting the lid and for properly locating the lid in said pocket, a plurality of inner pillows within said ring-like outer pillow, and said inner pillows being spaced from each other and from said outer pillow to comprise means for supporting the lid at a plurality of spaced locations.

2. The tray of claim 1 wherein said plurality of inner pillows comprise six pillows.

3. The tray of claim 1 including outwardly extending cornrs at each of the corners of said tray to provide added clearance for the corners of the lid.

4. The tray of claim 1 wherein there are three of said pockets in said tray aligned with each other, and said inner pillows comprising six pillows.

5. The tray of claim 1 in combination with a container in each of said pockets, each of said containers having a lid, a well in each of said lids, the peripheral edge of each of said lids including a lip extending around said well and including extended sides, and said lip and extended sides being mounted in said groove with said pillows being disposed in said well.

6. The combination of claim 5 wherein said lid is generally rectangularly shaped with rounded corners, and said ring-like pillow being of corresponding shape and of slightly smaller dimension to facilitate the placement of each container in its respective pocket.

7. The tray of claim 1 wherein said tray is nestable with other of said trays.

8. The tray of claim 1 in combination with a container in each of said pockets, each of said containers having a lid, a well in each of said lids, the peripheral edge of each of said lids including a lip extending around said well and extended sides, and said lip and extended sides being mounted in said groove with said pillows being disposed in said well.

9. The combination of claim 8 wherein said lid is generally rectangularly shaped with rounded corners, and said ring-like being of corresponding shape and of slightly smaller dimension to facilitate the placement of each container in its respective pocket.

10. The combination of claim 9 including a plastic shrink overwrap around said tray and said containers.

11. A molded pulp tray for holding cold containers comprising a bottom wall, upwardly and outwardly extending side walls terminating in a peripheral edge, a plurality of partitions extending upwardly from said bottom wall to divide said tray into a corresponding plurality of container receiving pockets, each of said pockets being defined by a portion of said bottom wall and by four peripheral sides comprising at least one of said partitions and at least one of said side walls, each of said pockets having at least one raised pillow extending upwardly from said bottom wall comprising a lid support surface for supporting the lid of a container when a container is mounted in said pocket in an inverted condition with the lid facing downward, said pillow being spaced inwardly from said peripheral sides of said pocket to create a peripheral groove in each pocket between said pillow and said peripheral sides whereby the edge of the outer surface of the lid may be disposed in the groove, said at least one pillow comprising a ring-like outer pillow located near but spaced from said peripheral sides with a plurality of inner pillows within said ring-like outer pillow; in combination with a container in each of said pockets, each of said containers having a lid, a well in each of said lids, the peripheral edge of each of said lids including a lip extending around said well and including extended sides, said lip and extended sides being mounted in said groove with said pillows being disposed in said well; said lid being generally rectangularly shaped with rounded corners, said ring-like pillow being of corresponding shape and of slightly smaller dimension to facilitate the placement of each container in its respective pocket, and a plastic shrink overwrap around said tray and said containers.

12. The combination of claim 11 wherein said containers are ice cream containers.

13. A molded pulp tray for holding cold containers comprising a bottom wall, upwardly and outwardly extending side walls terminating in a peripheral edge, a plurality of partitions extending upwardly from said bottom wall to divide said tray into a corresponding plurality of container receiving pockets, each of said pockets being defined by a portion of said bottom wall and by four peripheral sides comprising at least one of said partitions and at least one of said side walls, each of said pockets having at least one raised pillow extending upwardly from said bottom wall comprising a lid support surface for supporting the lid of a container when a container is mounted in said pocket inn an inverted condition with the lid facing downward, and said pillow being spaced inwardly from said peripheral sides of said pocket to create a peripheral groove in each pocket between said pillow and said peripheral sides whereby the edge of the outer surface of the lid may be disposed in the groove; in combination with a container in each of said pockets, each of said containers having a lid, a well in each of said lids, the peripheral edge of each of said lids including a lip extending around said well and including extended sides, said lip and extended sides being mounted in said groove with said pillows being disposed in said well, and a plastic shrink overwrap around said tray and said containers.

* * * * *

UNITED STATES PATENT AND TRADEMARK OFFICE

CERTIFICATE OF CORRECTION

PATENT NO. : 5,244,094

DATED : September 14, 1993

INVENTOR(S) : Graff, Jr. et al

It is certified that error appears in the above-indentified patent and that said Letters Patent is hereby corrected as shown below:

Column 6, line 37 "inn" should be --in--.

Signed and Sealed this

Thirteenth Day of September, 1994

*Attest:*

*Attesting Officer*

BRUCE LEHMAN

*Commissioner of Patents and Trademarks*

UNITED STATES PATENT AND TRADEMARK OFFICE

CERTIFICATE OF CORRECTION

PATENT NO. : 5,244,094

DATED : September 14, 1993

INVENTOR(S) : John F. Graff, Jr., et. al.

It is certified that error appears in the above-indentified patent and that said Letters Patent is hereby corrected as shown below:

Title page, item [73], Assignee: should read--Keyes Fibre Company, Waterville, Maine--;

Signed and Sealed this

First Day of November, 1994

*Attest:*

*Attesting Officer*

BRUCE LEHMAN

*Commissioner of Patents and Trademarks*